US005621444A

United States Patent [19]

Beeson

[11] Patent Number: 5,621,444

[45] Date of Patent: Apr. 15, 1997

[54] CONTROLLED HEATING OF SOLID INK IN INK-JET PRINTING

[75] Inventor: Robert R. Beeson, Corvallis, Oreg.

[73] Assignee: Hewlett-Packard Company, Palo Alto, Calif.

[21] Appl. No.: 350,928

[22] Filed: Dec. 7, 1994

[51] Int. Cl.[6] ..... B41J 2/175

[52] U.S. Cl. ..... 347/88; 347/92

[58] Field of Search ..... 347/17, 18, 88, 347/42, 92; 219/422, 421, 424, 426, 427, 420, 221, 227, 228, 229; 222/146.5

[56] References Cited

U.S. PATENT DOCUMENTS

| | | | |
|---|---|---|---|
| 3,032,635 | 5/1962 | Kraft . | |
| 4,190,426 | 2/1980 | Ruschke | 55/185 |
| 4,490,731 | 12/1984 | Vaught | 347/88 |
| 4,539,568 | 9/1985 | Lewis et al. | 347/88 |
| 4,580,147 | 4/1986 | DeYoung et al. | 347/88 |
| 4,788,556 | 11/1988 | Hoisington et al. | 347/88 |
| 4,791,439 | 12/1988 | Guiles | 347/88 |
| 4,814,786 | 3/1989 | Hoisington et al. | 347/88 |
| 4,937,598 | 6/1990 | Hine et al. | 347/88 |
| 5,105,209 | 4/1992 | Koto et al. | 347/88 X |
| 5,189,438 | 2/1993 | Hine et al. | 347/88 |
| 5,272,491 | 12/1993 | Asakawa et al. | 347/88 |
| 5,424,767 | 6/1995 | Alavizadeh et al. | 347/88 X |

FOREIGN PATENT DOCUMENTS

| | | | |
|---|---|---|---|
| 62-41044 | 2/1987 | Japan | 347/88 |
| 62-73953 | 4/1987 | Japan | 347/88 |

*Primary Examiner*—John E. Barlow, Jr.

[57] ABSTRACT

The solid ink in an ink-jet printer is melted and solidified in a manner that directs gasses in the ink to a location where those gasses may be collected and removed. Also provided is a corrugated heater that is disposed within the ink to melt the ink without interfering with the gas removal process.

21 Claims, 1 Drawing Sheet

CONTROLLED HEATING OF SOLID INK IN INK-JET PRINTING

TECHNICAL FIELD

This invention relates to removal of unwanted gasses from the ink of an ink-jet printer.

BACKGROUND INFORMATION AND SUMMARY OF THE INVENTION

One type of ink-jet printer employs ink that is solid under ambient conditions and is heated to a liquid state during the printing operation. The solid ink is stored in a reservoir that has a print head mounted to it. The print head includes a plurality of chambers into which the liquified ink flows. Each chamber has a contiguous orifice. The mechanism for ejecting the liquified ink from a chamber through a particular orifice may employ, for example, a minute heater, such as a thin-film resistor, that is instantaneously heated by a pulse of current directed through the resistor. The instantaneous heating of the resistor vaporizes a portion of the ink that is adjacent to the resistor, and the attendant expansion of the fluid in the chamber ejects a droplet of ink from the orifice to the paper or other print media that is advanced through the printer adjacent to the print head.

Such an ink-jet printer is permitted to cool when the printer is not being operated, so that the ink solidifies. As the ink solidifies, its volume decreases, as it melts its volume increases. This melting and heating cycle, along with operation of the droplet ejection mechanism just mentioned, leads to entrapment of gas bubbles within the ink. Gas bubbles are undesirable because they cause variations in the size and trajectory of the ink droplets, or may lead to complete depriming and failure of an ink-jet print head at one or more orifices.

This invention is directed to an apparatus and method for controlling the heating and cooling of solid ink in ink-jet printing in a manner such that gasses that may be trapped in the ink are directed away from the ink-jet print head to a location where they may be collected and purged from the ink supply system.

As one aspect of the invention, the heating of the ink is controlled so that the ink-jet print head may be reprimed prior to each operation of the printer.

As another aspect of the invention, heaters are provided for melting the solid ink. The heaters are configured and arranged to facilitate the removal of gasses trapped within the ink once the heaters are turned off.

DESCRIPTION OF PREFERRED EMBODIMENTS

Figure 1:
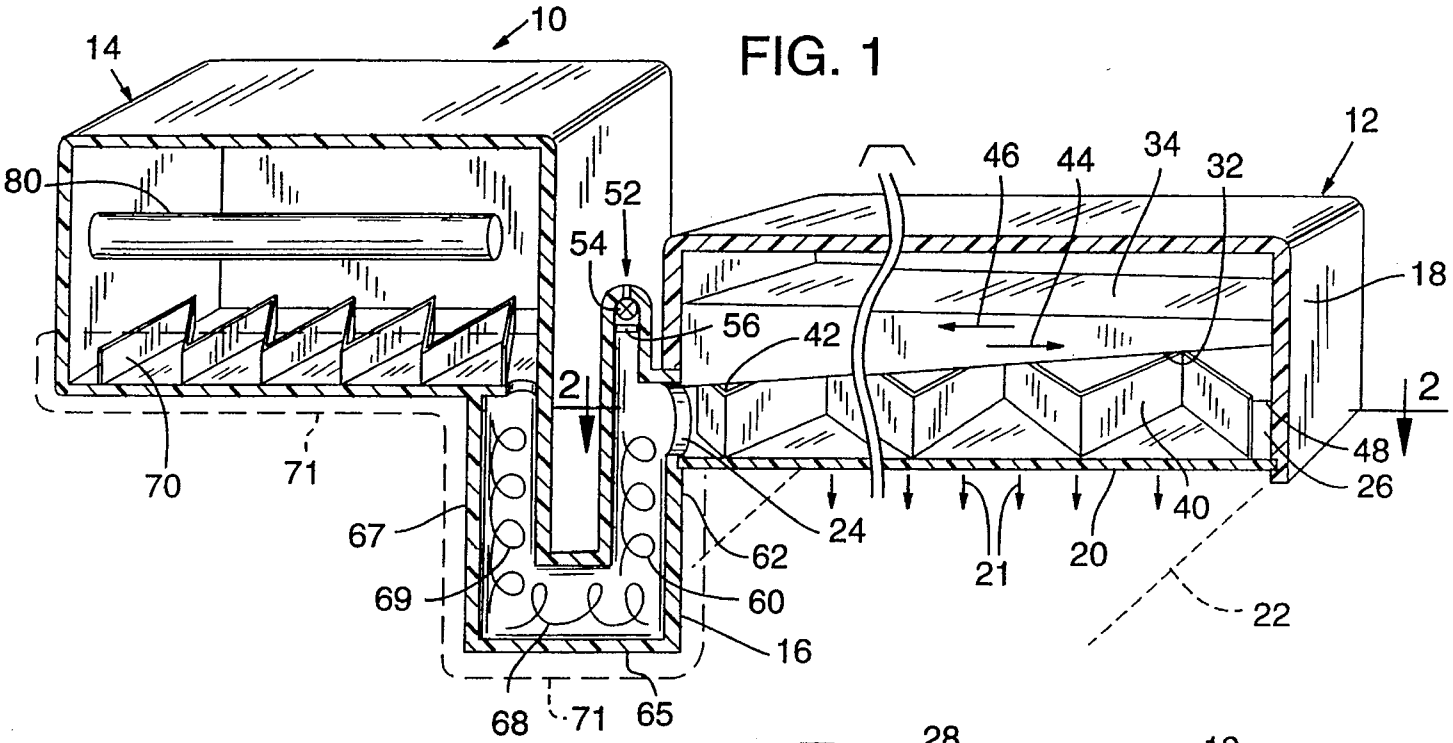
FIG. 1 is a cross-sectional diagram illustrating a preferred embodiment of the invention.

Referring to FIG. 1, there is shown an ink-jet priming system 10 with which the present invention may be employed. In particular, the system includes a pen 12 to which ink stored within a hopper 14 is conveyed through a conduit 16. The pen includes a reservoir 18 for holding the ink that is conveyed to the pen. A thermal-type print head 20 is attached to the underside of the reservoir and is controlled by the printer for selectively ejecting ink droplets, in the direction of arrows 21, to a piece of paper 22 or other printing media that is advanced through the printer.

In a preferred embodiment the pen is sized to span across the width of a piece of paper, hence remaining stationary as the paper is advanced. The pen 12 is not drawn to scale in the diagram of FIG. 1.

The print head 20 may be one of any conventional print heads. In the preferred embodiment, the print head may be a single thermal-type print head or array of thermal-type print heads as described in co-pending U.S. patent application No. 08/187,367, filed Apr. 24, 1992, hereby incorporated by reference.

Figure 2:
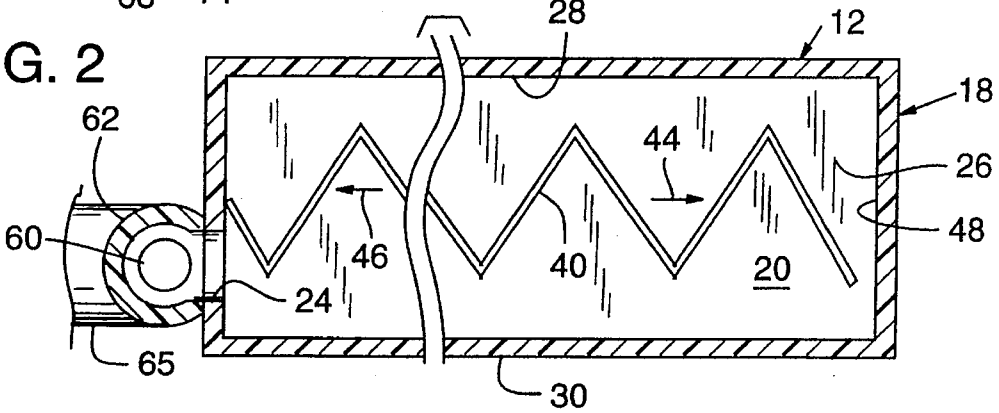
FIG. 2 is a cross-section view taken along line 2—2 of FIG. 1.

As described more fully below, the melted ink flows from the conduit 16 through a port 24 in the reservoir to fill an ink channel 26 that is defined within the reservoir. The channel 26 is between the back wall 28 of the reservoir and the front wall 30 of the reservoir (FIG. 2). The upper boundary of the ink channel 26 is defined by the undersurface 32 of a generally wedge-shaped heat sink 34 that is mounted inside the reservoir. The heat sink may be formed of, for example, stainless steel.

Ink within the channel 26 flows into the print head 20, from which droplets of the ink are selectively ejected during the printing operation.

A thin, flat heater 40, having a generally corrugated configuration is disposed within the ink channel 26. The heater 40 may be formed of conductive, metallic material such as titanium, having a thickness of less than about 0.1 mm. The heater 40 is oriented in the ink channel with its flat surfaces generally parallel to vertical so that any gas bubbles present in the liquified ink in the ink channel may rise upwardly so that the bubbles are free to collect within a narrow gap that exists between the top edge 42 of the heater 40 and the undersurface 32 of the heat sink.

The pitch and arrangement of the corrugated heater, (FIG. 2) should be selected so that all of the ink within the channel 26 can be heated sufficiently (to about, for example 130° C.) to reach and maintain the liquified or melted state during printing. To this end, the heater 40 is connected to a sufficient current source (not shown) for providing resistive-type heating in the heater.

The channel 26 is configured so that the volume of ink contained within the channel increases in the direction away from the port 24 along the length of the print head 20 to the far end 48 of the channel. For convenience, this direction will be referred to as the inlet direction and is illustrated with an arrow 44 in FIG. 2. The opposing, outlet direction is shown as arrow 46 in FIG. 2. The wedge-shaped heat sink 34 is configured so that its mass diminishes in the inlet direction 44 (hence, increases in the outlet direction 46).

The arrangement of the ink channel 26 and the heat sink 34 is such that the ink within the channel is progressively cooled and solidified after the heater 40 is turned off. Specifically, solidification of the ink occurs from one end 48 of the channel to the other end in the outlet direction 46. Conversely, when the printing operation is commenced, heater 40 is turned on and the solidified ink in the channel is progressively melted or liquified in the inlet direction 44. The significance of this progressive melting and solidifying of the ink is described more fully below.

When the heater 40 is turned on, the solidified ink in the channel 26 will progressively melt in the inlet direction 44 because the amount of ink in the channel 26 increases in that direction (hence, requires progressively more time to liquify). Put another way, the heater 40 is arranged so that it uniformly heats the ink within the channel from the inlet end at port 24 to the far end 48, the lesser volume of the ink near the port 24 melting first. As a result of this direction-controlled melting, the expansion of the ink attributable to the melting is directed out of the port 24 and into the conduit 16 (which, as described more fully below, is pre-heated so that the ink therein is in a liquid state before the heater 40 of the pen is turned on).

It will be appreciated that the heater 40 may also be arranged so that the pitch of the corrugations (hence, the amount of the heater) is gradually decreased in the inlet direction so that the heater could progressively melt the ink in the inlet direction even if the channel 26 were formed with a uniform volume in the inlet direction.

The progressive melting of the ink in the inlet direction 44 may be facilitated by sequentially heating the individual resistors in the print head 20 to a temperature sufficient to melt the ink in the vicinity of the orifice, but not so high as to cause the ink to be ejected from the orifice. To this end, the print head is controlled by the printer to sequentially heat the resistors in the inlet direction and retain the resistors in the heated state until all of the ink in the channel is melted (by heater 40) and the printing operation is ready to commence.

Preferably, the pen is reprimed before the printing operation commences, while the ink in the vicinity of the print head is in a liquid state. To this end, a vacuum service element, such as a resilient cup-shaped member to which a vacuum source is connected, is placed against the print head to cover the orifices. As a result, trapped gas and liquid is pulled through the orifices until only liquid ink remains in the vicinity of the orifices. Waste ink may be disposed of, or returned to the hopper 14.

Once the printing operation commences, only the resistors selected for ejecting ink from their associated orifices are heated to the level sufficient for ejecting the ink.

Heat that is present in the channel 26 during the printing operation (when the ink is liquid) is transferred to the heat sink 34. As noted above, the heat sink is configured to store a greater quantity of heat near the port 24, that quantity gradually diminishing in the inlet direction 44.

When the printing operation is halted and the heater 40 is turned off, the ink immediately adjacent to the print head will cool and solidify first, since that ink is in substantially direct contact with ambient air. The heat within the channel 26 will be dissipated in the far end 48 of the channel first, which end is adjacent to the smallest mass of the heat sink 34. Accordingly, the ink at the far end 48 will solidify first. The greater mass of the heat sink, located at the other end of the reservoir, will hold more heat longer to keep the ink in that portion of the channel 26 in the liquid state relatively longer than the ink in the far end. Consequently, the ink within the channel progressively solidifies along the length of the channel in the outlet direction 46.

As the liquid ink solidifies and contracts, the volume of ink attributable to the contraction flows into the port 24 so that no significant air voids will be developed in the channel as the ink cools. Moreover, any gas that may be trapped in the top of the chamber 26 at the underside of the heat sink element 32 will be forced to move in the outlet direction 46 by the gradually moving liquid/solid interface of the progressively solidifying ink. In the present embodiment, the gas will be moved out of the channel 26 through the port 24, whence it will be collected within a trap 52 for later purging from the system, as described below.

In view of the foregoing, it will be appreciated that a pen 12 made and operated in accordance with the above-described embodiment provides a generally passive and uncomplicated mechanism for removing unwanted gasses that may become trapped within the ink in the pen 12.

The conduit 16 is generally U-shaped and can be described as having three contiguous portions: an outlet portion 62, a base portion 65, and an inlet portion 67. A resistive type coil heater 60 is located inside the conduit near the port 24 of the pen. Another, independently controlled resistive heating coil 68 is located in the base portion 65 of the conduit, and a third independently controlled heating coil 69 is located in the inlet portion 67. It will be appreciated that there can be numerous variations in the conduit shape, and in the number of or arrangement of conduit heaters.

A corrugated, thin, metal heater element 70 is located in the bottom of the hopper 14. That lower heater 70 is substantially similar to the element 40 described above, being corrugated and having its flat surfaces arranged so that any gas bubbles are free to pass vertically upwardly within the hopper. The lower heater 70 is independently controlled as described more fully below.

Another heater 80 is located within the hopper 14 and spaced above the corrugated heater 70. The heater 80 is a primary heater employed for melting substantially all of the meltable ink contained in the hopper in instances where more liquid ink is needed to be supplied to the conduit 16. Otherwise, only the corrugated heater 70 is employed for maintaining a relatively small amount of liquid ink at the bottom hopper. In instances where the lower heater 70 is on and the upper heater 80 is off, there will typically reside an air gap in the hopper between the liquified ink in the bottom and the solid ink in the upper portion of the hopper.

When a printing operation is commenced, the lower heater 70, and conduit heaters 69, 68, and 60 are sequentially turned on to melt the ink within the bottom of the hopper and in the conduit. Because of the sequential heating of the heaters in the direction from the hopper (heater 70) to the port 24 (heater 60) the expansion volume of the melting ink is received in the bottom of the hopper.

The trap 52 is sealed from ambient with an electronically controlled valve 54. Within the trap 52 there is mounted a sensor 56 for detecting the presence of gas within the trap. If the presence of gas is sensed in the trap, the valve 54 is opened and gas is purged from the trap until the sensor detects the presence of liquid. The valve 54 is thereafter closed so that the conduit 16 is substantially free of any trapped gas.

After the trap valve 54 is closed, the pen heater 40 is turned on and, preferably, the print head resistors are sequentially heated as described above so that the solid ink within the channel 26 is melted progressively in the inlet direction 44. Printing is not commenced until the ink in the channel is completely liquified.

Before describing the cooling sequence occurring at the end of the printing operation, it is noteworthy that the portion of the hopper adjacent to the bottom heater 70, and substantially all of the conduit up to the pen reservoir 18, is thermally insulated as depicted by dashed line 71. The insulation may be any suitable coating or covering for minimizing heat loss from the liquid ink through the walls of the conduit 16 or bottom of the hopper 14. The insulation helps to retard the solidification of the ink in the conduit 16 relative to the solidification of the ink in the channel 26, so that ink is free to flow from the conduit 16 into the channel 26 while the ink within the channel is solidifying, and so that gas is free to pass out of the channel 26 through the port 24 and into the trap 52 before the ink in the conduit solidifies.

It is also noteworthy that, during printing, the content of the reservoir may be maintained to have a negative pressure (with respect to atmosphere) therein for preventing ink from leaking from the orifices. An apparatus for accomplishing this back pressure control is described in the above-mentioned U.S. patent application Ser. No. 08/187,367.

When a printing operation is completed, the above-described heaters are turned off sequentially. First, the heater 40 is turned off and the ink within the channel 26 progressively solidifies in the outlet direction 46 as explained above. Next, the heater 60 in the conduit 16 is turned off, followed by heater 68, then heater 69, then the lower heater 70 in the bottom of the hopper 14. The sequential cooling of the heaters as just mentioned continues the progressive solidification of the ink through the conduit and into the hopper 70. As a result, the ink within the hopper is free to flow into the conduit 16 to make up the volume decrease attributable to the solidification of the ink. Consequently, the ink changes from the liquid to solid state without the entrapment of large air gaps within the ink supply system.

Although the foregoing has been described in connection with preferred and alternative embodiments, it will be appreciated by one of ordinary skill in the art that various modifications and variations may be substituted for the mechanisms and method described here without departing from the invention as defined by the appended claims and their equivalents.

What is claimed is:

1. An apparatus for controlling heating and cooling of solid ink within an ink-jet printing system, comprising:

a reservoir for storing meltable ink, the reservoir including an inlet through which liquid ink may flow to fill the reservoir;

a heater assembly for applying heat to melt the ink within the reservoir so that the ink progressively melts in a first direction from near to away from the inlet; and a gas trap connected to the reservoir near the inlet to receive gasses released from the ink.

2. The apparatus of claim 1 wherein the heater assembly includes a heat sink mounted in the reservoir, the heat sink having a mass that diminishes in the first direction.

3. The apparatus of claim 1 wherein the gas trap includes a sensor for sensing the presence of gas therein, and a valve openable to release the gas in the trap.

4. The apparatus of claim 1 wherein the heater assembly includes a thin, resistive type heater member having a corrugated shape and disposed within the ink.

5. The apparatus of claim 1 including a thermal ink-jet print head that comprises an array of resistors, the print head attached to the reservoir to extend between the first and second ends of the reservoir, the heater assembly sequentially heating the resistors in the first direction for melting the ink in the vicinity of the resistors.

6. The apparatus of claim 5 wherein the heater assembly is operable for dissipating heat in a manner such that the melted ink progressively solidifies in a second direction that is generally opposite the first direction.

7. The apparatus of claim 5 wherein the heater assembly is operable for heating the resistors before applying heat to the ink within the channel.

8. The apparatus of claim 1 wherein the heater assembly includes a heater member disposed within the reservoir such that the heater member radiates a progressively decreasing amount of heat in a direction away from the inlet.

9. An apparatus for controlling heating and cooling of solid ink within an ink-jet printing system, comprising:

a reservoir for storing meltable ink, the reservoir including an inlet through which liquid ink may flow to fill the reservoir;

a heater assembly for applying heat to melt the ink within the reservoir so that the ink progressively melts in a first direction from near to away from the inlet; the heater assembly including a channel defined in the reservoir for storing the meltable ink, the channel having a volume that increases in the first direction; and a gas trap connected to the reservoir near the inlet to receive gasses released from the ink.

10. The apparatus of claim 9 wherein the heater assembly also includes a heat sink mounted in the reservoir, the heat sink having a mass that diminishes in the first direction.

11. A system for controlling the melting and solidifying of ink within an ink-jet printer, comprising:

a hopper for holding a supply of meltable ink;

a pen including a reservoir for holding meltable ink, and print head means for expelling melted ink droplets from the reservoir;

a conduit extending between the hopper and the pen for conducting melted ink from the hopper to the pen;

a heater element connected to the pen and that can be switched from off to on to apply heat to melt the ink in the pen; and a channel assembly for dissipating heat from the melted ink in the reservoir in a manner such that the melted ink progressively solidifies within the reservoir in a predetermined direction when the heater element is switched from on to off, the channel assembly including a channel defined by the reservoir to hold the ink within the pen, the channel having a volume that diminishes in the predetermined direction.

12. The system of claim 10 wherein the channel assembly also includes a heat sink mounted to the pen to extend adjacent to the channel and configured so that the mass of the heat sink increases in the predetermined direction.

13. The system of claim 11 wherein the channel assembly also includes a heat sink mounted to the pen to extend adjacent to the channel and configured so that the mass of the heat sink increases in the predetermined direction.

14. The system of claim 11 further comprising a trap connected to the channel to receive therein gas that is moved in the predetermined direction as a result of the progressive solidification of the ink in the reservoir.

15. The system of claim 11 including a second heater element connected to the conduit and that can be switched from off to on to melt the ink in the conduit.

16. The system of claim 15 including insulation applied to the conduit to retard relative to the ink in the channel the solidification of the ink in the conduit after the heater elements are switched off.

17. A method of controlling the melting and solidifying of ink within an ink-jet printer, comprising the steps of:

containing meltable ink within an elongated channel into which a supply of liquid ink may flow through an inlet and from which the ink may flow to an ink-jet print head during a printing operation;

progressively melting the ink within the channel beginning at the inlet prior to the printing operation;

stopping the printing operation; and progressively solidifying the ink along the length of the channel so that gas in the melted ink is moved to a predetermined location near the inlet for collection.

18. The method of claim 17 including the step of removing from the channel the gas that is moved to the predetermined location.

19. The method of claim 17 including the step of providing for the melting step a heater element having flat surfaces and arranged so that the flat surfaces are generally parallel to vertical.

20. The method of claim 17 including the steps of:

delivering meltable ink from a supply hopper to the channel through a conduit;

controlling the temperature of the hopper and the conduit so that the ink in the conduit solidifies after the ink in the channel solidifies and so that expansion of the ink in the conduit as the ink melts is directed into the hopper.

21. An apparatus for controlling heating and cooling of solid ink within an ink-jet printing system, comprising:

a reservoir for storing meltable ink, the reservoir including an inlet through which liquid ink may flow to fill the reservoir;

a heater assembly for applying heat to melt the ink within the reservoir so that the ink progressively melts in a first direction from near to away from the inlet, the heater assembly including a thin, resistive type heater member having a corrugated shape and disposed within the ink, wherein the corrugated shape of the resistive type heater member has a pitch that gradually decreases in a direction away from the inlet: and a gas trap connected to the reservoir near the inlet to receive gasses released from the ink.

* * * * *